US009624453B2

(12) United States Patent
Tamoto et al.

(10) Patent No.: US 9,624,453 B2
(45) Date of Patent: Apr. 18, 2017

(54) LUBRICATING OIL COMPOSITION AND AUTOMOTIVE TRANSMISSION OIL USING SAME

(71) Applicant: IDEMITSU KOSAN CO., LTD., Chiyoda-ku (JP)

(72) Inventors: Yoshitaka Tamoto, Chiba (JP); Toshihiko Ichihashi, Ichihara (JP); Masato Yokomizo, Narashino (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/413,832

(22) PCT Filed: Jul. 12, 2013

(86) PCT No.: PCT/JP2013/069200
§ 371 (c)(1),
(2) Date: Jan. 9, 2015

(87) PCT Pub. No.: WO2014/010735
PCT Pub. Date: Jan. 16, 2014

(65) Prior Publication Data

US 2015/0166927 A1 Jun. 18, 2015

(30) Foreign Application Priority Data

Jul. 13, 2012 (JP) ..... 2012-158138

(51) Int. Cl.
*C10M 169/04* (2006.01)
*C10L 1/18* (2006.01)
*C08G 63/00* (2006.01)

(52) U.S. Cl.
CPC .... *C10M 169/044* (2013.01); *C10M 169/041* (2013.01); *C10M 2205/0225* (2013.01); *C10M 2205/0285* (2013.01); *C10M 2207/0406* (2013.01); *C10M 2207/2835* (2013.01); *C10M 2209/084* (2013.01); *C10M 2209/108* (2013.01); *C10M 2209/109* (2013.01); *C10M 2209/1085* (2013.01); *C10M 2209/1095* (2013.01); *C10N 2220/021* (2013.01); *C10N 2220/022* (2013.01); *C10N 2230/02* (2013.01); *C10N 2230/68* (2013.01); *C10N 2230/70* (2013.01); *C10N 2240/02* (2013.01); *C10N 2240/04* (2013.01)

(58) Field of Classification Search
CPC ..... C10M 105/38; C10M 105/42
USPC ..... 508/492, 494, 287
See application file for complete search history.

(56) References Cited

U.S. PATENT DOCUMENTS 4,956,122 A 9/1990 Watts et al.
2004/0110647 A1* 6/2004 Gapinski ..... C10M 157/00 508/468
2005/0059563 A1* 3/2005 Sullivan ..... C10M 169/04 508/463
2012/0309659 A1 12/2012 Fujita
2012/0316092 A1 12/2012 Fujita et al.
2014/0256607 A1 9/2014 Tamoto et al.

FOREIGN PATENT DOCUMENTS

CN 101305084 11/2008
EP 2 772 525 A1 9/2014
JP 2004 277712 10/2004
JP 2008 179662 8/2008
JP 2009 292997 12/2009
JP 2010 143968 7/2010
JP 2011 162652 8/2011
JP 2011 168677 9/2011
JP WO 2013062008 A1 * 5/2013 ..... C10M 107/00
WO WO 2011/099207 A1 8/2011

OTHER PUBLICATIONS

International Search Report Issued Aug. 20, 2013 in PCT/JP13/069200 Filed Jul. 12, 2013.
Extended European Search Report issued on Apr. 7, 2016 in Patent Application No. 13817209.3.
"Group IV base stocks—PAO", UTS Seminar, ExxonMobil Chemical, XP055260987, Sep. 13-15, 2011, pp. 1-27.
Office Action issued Jan. 22, 2017 in Chinese Patent Application No. 201380036929.3.

* cited by examiner

*Primary Examiner* — James Goloboy
*Assistant Examiner* — Francis C Campanell
(74) *Attorney, Agent, or Firm* — Oblon, McClelland, Maier & Neustadt, L.L.P.

(57) ABSTRACT

An object of the present invention is to provide a lubricating oil composition having a low viscosity and an extremely high viscosity index as well as an excellent shearing stability. The present invention relates to a lubricating oil composition including the following components (A) to (C):

(A) a low-viscosity synthetic oil including a compound containing an ether bond in a molecule thereof and having a kinematic viscosity of less than 10 $mm^2/s$ as measured at 40° C., in which a ratio of the number of oxygen atoms to the number of carbon atoms as constituents of the compound (O/C ratio) and the kinematic viscosity ($mm^2/s$) of the compound as measured at 40° C. satisfy the following formula (1):

$$\text{Kinematic Viscosity at } 40^\circ\text{ C.} \leq 12-[(\text{O/C ratio})\times 30] \quad (1);$$

(B) a high-viscosity synthetic oil as a hydrocarbon-based synthetic oil having a kinematic viscosity of 40 $mm^2/s$ or more as measured at 100° C. which includes at least one compound selected from the group consisting of an α-olefin oligomer or a hydrogenated product of the α-olefin oligomer, and an ethylene-propylene co-oligomer; and (C) a polymethacrylate having a weight-average molecular weight of 50,000 or less.

17 Claims, No Drawings

LUBRICATING OIL COMPOSITION AND AUTOMOTIVE TRANSMISSION OIL USING SAME

CROSS-REFERENCE TO RELATED APPLICATIONS

This application is a National Stage of PCT/JP2013/069200, which was filed on Jul. 12, 2013. This application is based upon and claims the benefit of priority to Japanese Application No. 2012-158138, which was filed on Jul. 13, 2012.

BACKGROUND OF THE INVENTION

Technical Field

The present invention relates to a lubricating oil composition and a transmission fluid for vehicles which uses the lubricating oil composition.

Background Art

Lubricating oils have been inherently used for the purpose of reducing friction at sliding portions by forming an oil film on the sliding portions. Therefore, in order to form a strong oil film, it is advantageous that the lubricating oils have a high viscosity. On the other hand, as the viscosity of the lubricating oils becomes higher, an amount of power required upon stirring the lubricating oils or supplying the oils to lubricating parts is increased to thereby cause a large energy loss in a power engine and deterioration in fuel consumption. In consequence, in recent years, reduction in viscosity of the lubricating oils has proceeded to reduce a power loss and improve saving of energy and reduction in fuel consumption.

However, if the viscosity of the lubricating oils is excessively reduced, it becomes difficult to form an oil film on sliding portions when exposed to a high temperature. As a result, there tend to occur increase in friction at the sliding portions and abnormal abrasion thereof.

For this reason, in order to achieve both oil film formation under high temperature conditions and reduction of an energy loss in a normal temperature range or lower, it is considered effective to reduce a viscosity of the lubricating oils in the normal temperature range or lower while maintaining a high viscosity thereof under high temperature conditions. This means that the change in viscosity of the lubricating oils depending upon a temperature change is extremely reduced, i.e., there is a large demand for lubricating oils having an extremely high viscosity index (high VI).

To solve the above problem, there have been used lubricating oils that are improved by compounding an additive therein. For example, PTL1 to PTL3 have proposed lubricating oil compositions including a viscosity index improver as the additive.

CITATION LIST

Patent Literature

PTL1: JP 2009-292997A
PTL2: JP 2008-179662A
PTL3: JP 2010-143968A

SUMMARY OF INVENTION

Technical Problem

Although PTL1 to PTL3 describe that the lubricating oil compositions are improved in viscosity index, the viscosity index of the respective lubricating oil compositions is still as low as from below 200 to above 230, and the kinematic viscosity thereof in a low temperature range and a high temperature range is not low. Therefore, the lubricating oil compositions of PTL1 to PTL3 have failed to achieve saving of energy and reduction in fuel consumption as required at the present time.

Further, in the case where a high-molecular weight polymer for ordinary use is used as a viscosity index improver and simply incorporated into the lubricating oil compositions, the high-molecular weight polymer tends to suffer from mechanical shearing stress in the power engine and a part of a molecular structure thereof is cut to thereby cause deterioration in viscosity and viscosity index with time. That is, it is not easy to improve a viscosity index of the lubricating oil compositions without reducing a shearing stability thereof.

As described above, it is difficult to satisfy the three requirements including a low viscosity, a high viscosity index and a high shearing stability in lubricating oil compositions. There have been proposed no lubricating oil compositions capable of satisfying all of these requirements.

The present invention has been made in view of the above circumstances. An object of the present invention is to provide a lubricating oil composition having a low viscosity and an extremely high viscosity index as well as an excellent shearing stability, and a transmission fluid for vehicles which uses the lubricating oil composition.

Solution to Problem

As a result of intense and extensive researches for achieving the above object, the present inventors have found that when compounding a polymethacrylate having a weight-average molecular weight (Mw) of 50,000 or less in a base oil obtained by compounding a specific low-viscosity synthetic oil containing an ether bond with a specific high-viscosity synthetic oil, the above object can be effectively achieved. The present invention has been accomplished on the basis of the above finding.

Thus, the present invention relates to the following aspects.

1. A lubricating oil composition including the following components (A) to (C):

(A) a low-viscosity synthetic oil including a compound containing an ether bond in a molecule thereof and having a kinematic viscosity of less than 10 $mm^2/s$ as measured at 40° C., in which a ratio of the number of oxygen atoms to the number of carbon atoms as constituents of the compound (O/C ratio) and the kinematic viscosity ($mm^2/s$) of the compound as measured at 40° C. satisfy the following formula (1):

$$\text{Kinematic Viscosity at } 40^\circ\text{ C.} \leq 12-[(\text{O/C ratio})\times 30] \quad (1);$$

(B) a high-viscosity synthetic oil as a hydrocarbon-based synthetic oil having a kinematic viscosity of 40 $mm^2/s$ or more as measured at 100° C. which includes at least one compound selected from the group consisting of an α-olefin oligomer, a hydrogenated product of an α-olefin oligomer and an ethylene-propylene co-oligomer; and (C) a polymethacrylate having a weight-average molecular weight of 50,000 or less.

2. The lubricating oil composition according to the above aspect 1, wherein the component (A) is at least one compound selected from the group consisting of the following compounds (a-1) to (a-3):

(a-1) a dialkyl ether of di- (or tri-) ethylene glycol (wherein two alkyl groups in the dialkyl ether may be the same or different from each other);

(a-2) di- (or tri-) ethylene glycol containing an alkyl ether at one terminal end thereof and an alkyl ester at the other terminal end thereof, and (a-3) an alkoxyalkyl ester of a saturated or unsaturated fatty acid.

3. The lubricating oil composition according to the above aspect 1 or 2, wherein the component (B) is an α-olefin oligomer and/or a hydrogenated product of an α-olefin oligomer which have a kinematic viscosity of from 100 to 1,000 $mm^2/s$ as measured at 100° C.

4. The lubricating oil composition according to any one of the above aspects 1 to 3, wherein the component (B) is an α-olefin oligomer that is produced by using a metallocene catalyst and/or a hydrogenated product of the α-olefin oligomer.

5. The lubricating oil composition according to any one of the above aspects 1 to 4, wherein a content of the component (C) in the lubricating oil composition is 15% by mass or less on the basis of a total amount of the component A, the component B and the component C.

6. The lubricating oil composition according to any one of the above aspects 1 to 5, wherein a content of the component (A) in the lubricating oil composition is from 5 to 80% by mass, and a content of the component (B) in the lubricating oil composition is from 10 to 80% by mass, both on the basis of a total amount of the component A, the component B and the component C.

7. The lubricating oil composition according to any one of the above aspects 1 to 6, wherein the lubricating oil composition has a kinematic viscosity of 3 $mm^2/s$ or more as measured at 100° C.

8. The lubricating oil composition according to any one of the above aspects 1 to 7, wherein the lubricating oil composition has a viscosity index of 250 or more.

9. The lubricating oil composition according to any one of the above aspects 1 to 8, further including, as a component (D), at least one lubricating oil additive selected from the group consisting of an antioxidant, an extreme pressure agent or an anti-wear agent, a dispersant and a metal-based detergent.

10. A transmission fluid for vehicles including the lubricating oil composition according to any one of the above aspects 1 to 9.

Advantageous Effects of Invention

In accordance with the present invention, it is possible to provide a lubricating oil composition having a low viscosity and an extremely high viscosity index as well as an excellent shearing stability which is excellent in saving of energy and reduction in fuel consumption. The lubricating oil composition can be suitably used, in particular, as a transmission fluid for vehicles.

DESCRIPTION OF EMBODIMENTS

The lubricating oil composition according to present invention includes (A) a low-viscosity synthetic oil, (B) a high-viscosity synthetic oil and (C) a polymethacrylate having a weight-average molecular weight of 50,000 or less.

[Low-Viscosity Synthetic Oil (Component A)]

It is required that the low-viscosity synthetic oil used as the component A in the present invention is in the form of a compound containing an ether bond in a molecule thereof. The compound may contain at least one ether bond in a molecule thereof, and may also contain two or more ether bonds in a molecule thereof. The number of ether bonds contained in a molecule of the compound is preferably from 1 to 6, more preferably from 1 to 4 and still more preferably from 3 to 4.

In addition, the compound containing an ether bond in a molecule thereof may also contain the other bond such as, for example, an ester bond. The use of the compound containing an ester bond in a molecule thereof is suitable to increase a flash point of of the resulting lubricating oil composition.

It is required that the low-viscosity synthetic oil as the component A is in the form of a compound having a kinematic viscosity of less than 10 $mm^2/s$ as measured at 40° C. The component A is used in the lubricating oil composition to reduce a kinematic viscosity of the composition and achieve saving of energy and reduction in fuel consumption. For this reason, the kinematic viscosity of the component A as measured at 40° C. is preferably 9 $mm^2/s$ or less, more preferably 8 $mm^2/s$ or less, still more preferably 5 $mm^2/s$ or less, and most preferably 2 $mm^2/s$ or less.

Meanwhile, the lower limit of the kinematic viscosity of the component A as measured at 40° C. is not particularly limited, and is preferably 1 $mm^2/s$ or more, and more preferably 1.5 $mm^2/s$ or more, from the viewpoint of preventing occurrence of evaporation loss of the lubricating oil composition, etc.

The compound containing an ether bond in a molecule thereof as the component A is further required to be a low-viscosity synthetic oil in which a ratio of the number of oxygen atoms to the number of carbon atoms as constituents of the compound (0/C ratio) and the kinematic viscosity ($mm^2/s$) of the compound as measured at 40° C. satisfy the following formula (1):

$$\text{Kinematic Viscosity at } 40^\circ\text{ C.} \leq 12-[(\text{O/C ratio})\times 30] \quad (1).$$

When the number of oxygen atoms contained in the compound containing an ether bond in a molecule thereof is relatively larger than the number of carbon atoms contained therein, there is such a tendency that the molecule of the compound has an increased polarity, so that the resulting composition is increased in viscosity index but deteriorated in solubility.

When the compound containing an ether bond in a molecule thereof has such an O/C ratio as controlled to satisfy the above formula (1), the resulting composition has a good solubility and can exhibit a low viscosity and a good viscosity index. Meanwhile, in order to further enhance the above effects, the upper limit of the right-side value of the above formula (1) is preferably adjusted to 8.5.

The component A used in the present invention may include one or more compounds capable of satisfying the above requirements. Of these compounds, from the viewpoint of a good availability, at least one compound selected from the group consisting of the following compounds (a-1) to (a-3) is preferably used as the component A:

(a-1) a dialkyl ether of di- (or tri-) ethylene glycol (wherein two alkyl groups in the dialkyl ether may be the same or different from each other);

(a-2) di- (or tri-) ethylene glycol containing an alkyl ether at one terminal end thereof and an alkyl ester at the other terminal end thereof; and (a-3) an alkoxyalkyl ester of a saturated or unsaturated fatty acid.

In the above compounds (a-1) to (a-3), the alkyl ether, alkyl ester and alkoxyalkyl ester as well as the number of carbon atoms in the fatty acid may be determined such that the requirements of the kinematic viscosity of the respective compounds as measured at 40° C. and the above formula (1) are satisfied.

Examples of the alkyl ether include ethyl ether, propyl ether, butyl ether, hexyl ether and hexyl butyl ether. The ether group of these alkyl ethers may be in the form of a monoether, a diether, a triether or the like. Among these alkyl ethers, preferred is dibutyl ether. Examples of the alkyl ester include a decanoic acid alkyl ester, an octanoic acid alkyl ester and a nonanoic acid alkyl ester. Among these alkyl esters, preferred is an octanoic acid alkyl ester. Examples of the alkoxyalkyl ester of a saturated or unsaturated fatty acid include palmitoleic acid butoxyethyl ester, oleic acid butoxyethyl ester and elaidic acid butoxyethyl ester. Among these alkoxyalkyl esters of a saturated or unsaturated fatty acid, preferred is oleic acid butoxyethyl ester.

Also, form the viewpoint of increasing a viscosity index of the lubricating oil composition, of these components (a-1) to (a-3), preferred is the component (a-1). The content of the component (a-1) in the component A is preferably 40% by mass or more, more preferably 80% by mass or more, and still more preferably 95% by mass or more.

The lower limit of the content of the component A in the lubricating oil composition is usually 5% by mass or more, preferably 20% by mass or more, more preferably 30% by mass or more, and still more preferably 40% by mass or more on the basis of a total amount of the components A, B and C. Also, the upper limit of the content of the component A in the lubricating oil composition is usually 80% by mass or less, preferably 70% by mass or less, and more preferably 60% by mass or less on the basis of a total amount of the components A, B and C. When the content of the component A in the lubricating oil composition is controlled to 80% by mass or less on the basis of a total amount of the components A, B and C, it is possible to obtain a composition having a good solubility and a high stability.

Also, the lower limit of the kinematic viscosity of the low-viscosity synthetic oil as the component A as measured at 100° C. is preferably 0.5 $mm^2/s$ or more, and more preferably 0.7 $mm^2/s$ or more, whereas the upper limit of the kinematic viscosity of the low-viscosity synthetic oil as the component A as measured at 100° C. is preferably 3.0 $mm^2/s$ or less, more preferably 2.0 $mm^2/s$ or less and still more preferably 1.5 $mm^2/s$ or less. When the kinematic viscosity of the component A as measured at 100° C. is controlled to the above-specified range, it is possible to readily achieve both a high viscosity index and a low viscosity of the resulting lubricating oil composition.

[High-Viscosity Synthetic Oil (Component B)]

In the present invention, as the component B, there is used a hydrocarbon-based synthetic oil having a kinematic viscosity of 40 $mm^2/s$ or more as measured at 100° C.

When the kinematic viscosity of the component B as measured at 100° C. is less than 40 $mm^2/s$, it is not possible to obtain a lubricating oil composition having a sufficiently high viscosity index. Therefore, the kinematic viscosity of the component B as measured at 100° C. is preferably 50 $mm^2/s$ or more, more preferably 80 $mm^2/s$ or more and still more preferably 100 $mm^2/s$ or more.

The upper limit of the kinematic viscosity of the component B as measured at 100° C. is not particularly limited, but is preferably 1,000 $mm^2/s$ or less, more preferably 500 $mm^2/s$ or less and still more preferably 350 $mm^2/s$ or less in view of preventing deterioration in shearing stability of the lubricating oil composition.

In the present invention, as the above hydrocarbon-based high-viscosity synthetic oil (component B) having the above-specified kinematic viscosity, there may be used at least one compound selected from the group consisting of an α-olefin oligomer, a hydrogenated product of an α-olefin oligomer and an ethylene-propylene co-oligomer. Among these compounds, from the viewpoint of suppressing increase in viscosity of the composition at a low temperature, preferred are the α-olefin oligomer and/or the hydrogenated product of the α-olefin oligomer.

The raw material of the α-olefin oligomer or the hydrogenated product of the α-olefin oligomer may be any α-olefin having a straight chain structure or a branched chain structure. More specifically, α-olefins having 8 to 12 carbon atoms which are selected from the group consisting of 1-octene, 1-nonene, 1 decene, 1-undecene and 1-dodecene may be used singly or in combination of any two or more thereof.

Of these compounds, there may be suitably used the α-olefin oligomer and/or the hydrogenated product of the α-olefin oligomer which are produced by using 1-decene as the raw material.

The polymerization of the above α-olefins may be carried out by using various catalysts. Examples of the polymerization catalysts include metallocene catalysts and so-called non-metallocene catalysts such as boron trifluoride ($BF_3$) and Ziegler catalysts.

Of these compounds, the α-olefin oligomers produced using the metallocene catalysts and the hydrogenated α-olefin oligomers produced by further hydrogenating the α-olefin oligomers are preferred from the viewpoints of a high viscosity index thereof, etc.

As the metallocene catalysts, a complex having a conjugated carbon 5-membered ring containing an element belonging to Group 4 of the Periodic Table, i.e., a metallocene complex, may be used in combination with an oxygen-containing organoaluminum compound.

Examples of the element belonging to Group 4 of the Periodic Table contained in the metallocene complex include titanium, zirconium and hafnium. Among these elements, especially preferred is zirconium. The complex having a conjugated carbon 5-membered ring may be generally used in the form of a complex having a substituted or unsubstituted cyclopentadienyl ligand.

Suitable examples of the metallocene complex include bis(n-octadecyl cyclopentadienyl) zirconium dichloride, bis (trimethylsilyl cyclopentadienyl) zirconium dichloride, bis (tetrahydroindenyl) zirconium dichloride, bis[(t-butyldimethylsilyl) cyclopentadienyl] zirconium dichloride, bis(di-t-butyl cyclopentadienyl) zirconium dichloride, (ethylidenebisindenyl) zirconium dichloride, biscyclopentadienyl zirconium dichloride, ethylidenebis(tetrahydroindenyl) zirconium dichloride and bis[3,3(2-methyl-benzindenyl)] dimethylsilane-diyl zirconium dichloride. These metallocene complexes may be used alone or in combination of any two or more thereof.

On the other hand, examples of the oxygen-containing organoaluminum compound include methyl alumoxane, ethyl alumoxane and isobutyl alumoxane. These oxygen-containing organoaluminum compounds may be used alone or in combination of any two or more thereof.

The ethylene-propylene co-oligomer used as the component B is not particularly limited, and may be used in the form of an ethylene-propylene copolymer having an ethylene content of usually from 10 to 90 mol % and preferably from 20 to 80 mol %. Such a co-oligomer can exhibit a high viscosity index and a good shearing stability.

The lower limit of the content of the component B in the lubricating oil composition is preferably 10% by mass or more, more preferably 20% by mass or more, and still more preferably 30% by mass or more on the basis of a total amount of the components A, B and C. Also, the upper limit of the content of the component B in the lubricating oil composition is preferably 80% by mass or less, more preferably 60% by mass or less, and still more preferably 50% by mass or less on the basis of a total amount of the components A, B and C. When the content of the component B in the lubricating oil composition is 10% by mass or more on the basis of a total amount of the components A, B and C, it is possible to readily enhance a viscosity index of the lubricating oil composition. On the other hand, when the content of the component B in the lubricating oil composition is 80% by mass or less on the basis of a total amount of the components A, B and C, it is possible to obtain a composition having a good solubility and a high stability.

The ratio of the content of the component A to the content of the component B ([content of component A]/[content of component B]) in the lubricating oil composition is preferably from 1.3 to 3.0, and more preferably from 1.6 to 2.0.

[Polymethacrylate Having Weight-Average Molecular Weight of 50,000 or less (Component C)]

In the present invention, as the component C, there is used a polymethacrylate having a weight-average molecular weight of 50,000 or less.

By using the component C in addition to the above components A and B, it is possible to obtain a lubricating oil composition having a low viscosity and an extremely high viscosity index as well as an excellent shearing stability.

On the other hand, when using a polymethacrylate having a weight-average molecular weight of more than 50,000, although the viscosity index is improved, the resulting composition tends to fail to exhibit a good shearing stability. In addition, in the case of using an olefin copolymer that is generally known as a viscosity index improver, it is not possible to obtain a composition having a sufficiently enhanced viscosity index.

The weight-average molecular weight of the polymethacrylate is preferably 50,000 or less, and more preferably 40,000 or less.

Meanwhile, the weight-average molecular weight may be measured, for example, by size exclusion chromatography. As an apparatus utilizing the size exclusion chromatography, there may be mentioned "Prominence GPC System" available from Shimadzu Corp.

The upper limit of the content of the component C in the lubricating oil composition is preferably 15% by mass or less, more preferably 10% by mass or less, and still more preferably 8% by mass or less on the basis of a total amount of the components A, B and C. Also, the lower limit of the content of the component C in the lubricating oil composition is preferably 0.1% by mass or more, more preferably 0.5% by mass or more, and still more preferably 2% by mass or more on the basis of a total amount of the components A, B and C. When the content of the component C in the lubricating oil composition is 15% by mass or less on the basis of a total amount of the components A, B and C, it is possible to readily achieve not only enhancement of a shearing stability of the lubricating oil composition, but also reduction in a viscosity of the lubricating oil composition. When the content of the component C in the lubricating oil composition is 0.1% by mass or more on the basis of a total amount of the components A, B and C, it is possible to readily enhance a viscosity index of the lubricating oil composition.

The total content of the components A, B and C in the lubricating oil composition is preferably 70% by mass or more, more preferably 80% by mass or more, and still more preferably 90% by mass or more.

[Lubricating Oil Additive (Component D)]

The lubricating oil composition containing the components A, B and C according to the present invention may be further compounded with a lubricating oil additive as a component D.

As the lubricating oil additive as the component D, there may be mentioned (d-1) an antioxidant, (d-2) an extreme pressure agent or an anti-wear agent, (d-3) a dispersant, (d-4) a metal-based detergent and (d-5) other lubricating oil additives, etc. It is preferred that one or more lubricating oil additives selected from these materials are compounded in the lubricating oil composition.

Examples of the antioxidant as the component (d-1) include an amine-based antioxidant, a phenol-based antioxidant and a sulfur-based antioxidant.

Specific examples of the amine-based antioxidant include dialkyl (number of carbon atoms in the alkyl group: from 1 to 20) diphenyl amines such as 4,4'-dibutyl diphenyl amine, 4,4'-dioctyl diphenyl amine and 4,4'-dinonyl diphenyl amine; and naphthyl amines such as phenyl-α-naphthyl amine, octyl phenyl-α-naphthyl amine and nonyl phenyl-α-naphthyl amine.

Specific examples of the phenol-based antioxidant include monophenol-based antioxidants such as 2,6-di-tert-butyl-4-methyl phenol and 2,6-di-tert-butyl-4-ethyl phenol; and diphenol-based antioxidants such as 4,4'-methylenebis (2,6-di-tert-butyl phenol) and 2,2'-methylenebis(4-ethyl-6-tert-butyl phenol).

Specific examples of the sulfur-based antioxidant include phenothiazine, pentaerythritol-tetrakis-(3-lauryl thiopropionate), bis(3,5-tert-butyl-4-hydroxybenzyl) sulfide, thiodiethylenebis(3-(3,5-di-tert-butyl-4-hydroxyphenyl)) propionate and 2,6-di-tert-butyl-4-(4,6-bis(octylthio)-1,3,5-triazine-2-methylamino) phenol.

These antioxidants may be used alone or in combination of any two or ore thereof. The amount of the antioxidant compounded in the lubricating oil composition is usually from 0.01 to 10% by mass and preferably from 0.03 to 5% by mass on the basis of a whole amount of the lubricating oil composition.

Examples of the extreme pressure agent or anti-wear agent as the component (d-2) include a sulfur-based extreme pressure agent, a phosphorus-based anti-wear agent, an S-P-based extreme pressure agent, zinc hydrocarbyl dithiophosphate and a thiazole-based extreme pressure agent.

Specific examples of the sulfur-based extreme pressure agent include sulfurized oils and fats, sulfurized fatty acids, sulfurized esters, sulfurized olefins, dihydrocarbyl polysulfides, thiadiazole compounds, alkyl thiocarbamoyl compounds, thiocarbamate compounds, thioterpene compounds and dialkyl thiodipropionate compounds.

Specific examples of the phosphorus-based anti-wear agent include phosphoric acid ester compounds such as phosphoric acid esters, acidic phosphoric acid esters, phosphorous acid esters and acidic phosphorous acid esters, and amine salts of these phosphoric acid ester compounds.

The S-P-based extreme pressure agent may be in the form of either a compound containing sulfur and phosphorus in a molecule thereof, such as a thiophosphoric acid ester such as triphenyl thiophosphate and lauryl trithiophosphate, or a mixture of the sulfur-based extreme pressure agent and the phosphorus-based extreme pressure agent. When the S-P-based extreme pressure agent is used in the form of a mixture of the sulfur-based extreme pressure agent and the phosphorus-based extreme pressure agent, the sulfur-based and phosphorus-based extreme pressure agents may be respectively selected from the sulfur-based extreme pressure agents and the phosphorus-based anti-wear agents as exemplified above.

In addition, the hydrocarbyl group of the zinc dihydrocarbyl dithiophosphate (ZnDTP) may be any of a linear or branched alkyl group having 1 to 24 carbon atoms, a linear or branched alkenyl group having 3 to 24 carbon atoms, a cycloalkyl group or linear or branched alkyl cycloalkyl group having 5 to 13 carbon atoms, an aryl group or linear or branched alkyl aryl group having 6 to 18 carbon atoms, and an arylalkyl group having 7 to 19 carbon atoms, etc. Also, the alkyl group or the alkenyl group as the hydrocarbyl group may be in the form of either a primary group, a secondary group or a tertiary group.

Specific examples of the thiadiazole compounds include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole and 4,5-bis(1,1,3,3-tetramethylbutyldithio)-1,2,3-thiadiazole.

These extreme pressure agents or anti-wear agents may be used alone or in combination of any two or more thereof. The amount of the extreme pressure agent or anti-wear agent compounded in the lubricating oil composition is usually in the range of from 0.01 to 10% by mass and preferably from 0.05 to 5% by mass on the basis of a whole amount of the lubricating oil composition.

Examples of the dispersant as the component (d-3) include an imide-based dispersant, an amide-based dispersant and an ester-based dispersant.

Specific examples of the dispersant include an alkenyl group-substituted alkenyl succinic acid imide having an average molecular weight of from 1000 to 3500 or a boronated product thereof, benzyl amine, alkyl polyamines and alkenyl succinic acid esters.

These dispersants may be used alone or in combination of any two or more thereof. The amount of the dispersant compounded in the lubricating oil composition is usually in the range of from 0.05 to 10% by mass and preferably from 0.1 to 5% by mass on the basis of a whole amount of the lubricating oil composition.

Examples of the metal-based detergent as the component (d-4) include sulfonates of alkali earth metals such as Ca, Mg and Ba, phenates of alkali earth metals, salicylates of alkali earth metals and phosphonates of alkali earth metals. These metal-based detergents may be either neutral, basic or perbasic.

These metal-based detergents may be used alone or in combination of any two or more thereof. The amount of the metal-based detergent compounded in the lubricating oil composition is usually in the range of from 0.05 to 30% by mass and preferably from 0.1 to 10% by mass on the basis of a whole amount of the lubricating oil composition.

Examples of the other lubricating oil additives (d-5) include a defoaming agent, a metal deactivator, an oiliness agent, a rust-preventive agent, an anti-corrosion agent and a pour point depressant. Specific examples of the defoaming agent include silicone oils and fluorinated silicone oils. Specific examples of the metal deactivator include copper deactivators such as N-[N,N'-dialkyl($C_3$ to $C_{12}$ alkyl group) aminoethyl] triazole. The amount of these lubricating oil additives compounded in the lubricating oil composition is usually in the range of from 0.05 to 30% by mass, and preferably from 0.1 to 10% by mass on the basis of a whole amount of the lubricating oil composition.

The total amount of the lubricating oil additives compounded in the lubricating oil composition of the present invention is preferably from 1 to 20 parts by mass, more preferably from 3 to 15 parts by mass, and still more preferably from 5 to 10 parts by mass on the basis of 100 parts by mass of a total amount of the components A, B and C.

[Other Components]

The lubricating oil composition of the present invention may be further compounded with a lubricant base oil in addition to the above components unless the object of the present invention is adversely affected by addition of the lubricant base oil.

Examples of the lubricant base oil include mineral oils having a kinematic viscosity of 10 $mm^2/s$ or less as measured at 100° C., and synthetic oils such as α-olefin oligomers, polybutene and polyol esters. The lubricant base oil is preferably compounded in an amount of 30% by mass or less, more preferably 20% by mass or less, and still more preferably 10% by mass or less on the basis of the lubricating oil composition.

[Lubricating Oil Composition]

As described above, the lubricating oil composition of the present invention contains the components A, B and C as essential components, and further may contain the component D and the other components as optional components, if required.

The viscosity index of the lubricating oil composition of the present invention is preferably 250 or more, more preferably 280 or more, still more preferably 300 or more, and even still more preferably 310 or more. When the viscosity index of the lubricating oil composition is 250 or more, the resulting lubricating oil composition is capable of readily forming an oil film on sliding portions at a high temperature while achieving saving of energy and reduction in fuel consumption.

In addition, the shearing stability of the lubricating oil composition of the present invention is preferably 4.0% or less, more preferably 2.0% or less, and still more preferably 1.5% or less. When the shearing stability of the lubricating oil composition is adjusted to 4.0% or less, it is possible to maintain a good lubricating performance of the composition for a long period of time. Meanwhile, the shearing stability is the value measured by SONIC test described in the below-mentioned Examples.

The kinematic viscosity of the lubricating oil composition of the present invention is not particularly limited, and may be appropriately determined according to the aimed applications or conditions upon use of the lubricating oil composition. For example, in the case where the lubricating oil composition is used as a transmission fluid for vehicles, the kinematic viscosity of the lubricating oil composition as measured at 40° C. is preferably 25 $mm^2/s$ or less, more preferably 20 $mm^2/s$ or less, and still more preferably 17 $mm^2/s$ or less, and the kinematic viscosity of the lubricating oil composition as measured at 100° C. is preferably 3 $mm^2/s$ or more, more preferably 3.5 $mm^2/s$ or more, and still more preferably 5.5 $mm^2/s$ or more.

The lubricating oil composition of the present invention can be used as transmission fluids for vehicles, industrial bearing oils, industrial gear oils, gear oils for vehicles, etc., in particular, can be suitably used as transmission fluids for vehicles because of a low viscosity and an extremely high viscosity index as well as an excellent shearing stability thereof. As the transmission for vehicles, there may be mentioned a manual transmission, an automatic transmission and a continuous variable transmission (CVT). The lubricating oil composition of the present invention can be especially suitably used for the continuous variable transmission among the above transmissions.

EXAMPLES

The present invention will be described below in more detail by referring to the following examples, etc. However, it should be noted that these examples are only illustrative and not intended to limit the invention thereto. Meanwhile, in the following Examples, etc., the evaluation and measurement of the lubricating oil compositions were conducted by the following methods.

<Methods for Evaluation and Measurement of Lubricating Oil Composition>

(1) Solubility of Lubricating Oil Composition

The lubricating oil composition prepared by the below method was allowed to stand at room temperature for 8 h, and then an appearance of the lubricating oil composition was observed by naked eyes to examine whether or not any insoluble components were precipitated. The case where the lubricating oil composition was free from precipitation of insoluble components and exhibited a good solubility was expressed by "OK", whereas the case where the lubricating oil composition suffered from precipitation of insoluble components and exhibited a poor solubility was expressed by "NG".

(2) Kinematic Viscosity

Measured according to JIS K2283.

(3) Viscosity Index

Measured according to JIS K2283.

(4) Shearing Stability (SONIC Test)

A fresh oil (30 mL) produced in the respective Examples and Comparative Examples was irradiated with an ultrasonic wave for 1 h under the testing conditions prescribed in JASO M347-95 (ultrasonic treatment product), and the thus obtained ultrasonic treatment product was measured for its kinematic viscosity at 100° C. On the other hand, a fresh oil produced in the respective Examples and Comparative Examples (non-treated product) was measured for its kinematic viscosity at 100° C. Then, the kinematic viscosity of the ultrasonic treatment product was compared with that of the non-treated product to calculate a rate of change in kinematic viscosity of the oil at 100° C. (a reduction rate of the kinematic viscosity).

(5) Flash Point

Measured according to JIS K 2265 (COC method).

Examples 1 to 10 and Comparative Examples 1 to 10

The lubricating oil compositions having the formulations shown in Tables 2 and 3 were prepared using the materials shown in Table 1. The thus prepared lubricating oil compositions were subjected to evaluation of a solubility thereof, and also subjected to measurements of a kinematic viscosity, a viscosity index, a shearing stability and a flash point thereof. The methods for evaluation and measurement of these properties of the lubricating oil compositions are shown above. Meanwhile, the lubricating oil compositions were prepared in such a manner that the respective materials used for preparing the compositions were mixed and stirred at 60° C. for 30 min.

In addition, the lubricating oil additives used in the respective Examples and Comparative Examples shown in Tables 2 and 3 were used in the form of a package of the compounds shown in the column "Contents" for "Lubricating oil additives" in Table 1, and all were constituted of the same package.

Incidentally, the symbols used for indicating the respective raw materials as shown in Tables 1 to 3 mean the following compounds.

ET: Compounds containing an ether bond;

ETS: Compounds containing an ether bond and an ester bond;

ES: Compounds containing an ester bond;

PAO: α-Olefin oligomers;

HV-PAO: High-viscosity α-olefin oligomers;

PMA: Polymethacrylates.

TABLE 1

| Symbol for raw materials | Contents | Number of C | Number of O | O/C atomic ratio | Kinematic viscosity at 40° C. | Kinematic viscosity at 100° C. | Viscosity index | Right-side value of formula (1) | Formula (1) can be satisfied or unsatisfied |
|---|---|---|---|---|---|---|---|---|---|
| Low-viscosity synthetic oil | | | | | | | | | |
| ET1 | *1 | 13 | 3 | 0.231 | 1.84 | 0.85 | — | 5.1 | satisfied |
| ET2 | *2 | 14 | 3 | 0.214 | 2.39 | 1.07 | — | 5.6 | satisfied |
| ET3 | *3 | 14 | 4 | 0.286 | 2.67 | 1.16 | — | 3.4 | satisfied |
| ETS1 | *4 | 24 | 3 | 0.125 | 7.51 | 2.54 | 197 | 8.3 | satisfied |
| ETS2 | *5 | 22 | 6 | 0.273 | 8.92 | 2.72 | 158 | 3.8 | unsatisfied |
| ETS3 | *6 | 18 | 5 | 0.278 | 5.17 | 1.86 | — | 3.7 | unsatisfied |
| ETS4 | *7 | 24 | 5 | 0.208 | 10.00 | 2.94 | 158 | 5.8 | unsatisfied |
| ES1 | *8 | — | — | — | 5.78 | 2.07 | 188 | — | — |
| ES2 | *9 | — | — | — | 3.36 | 1.36 | — | — | — |
| ES3 | *10 | — | — | — | 11.50 | 3.20 | 152 | — | — |
| PAO | *11 | — | — | — | 5.29 | 1.70 | — | — | — |
| High-viscosity synthetic oil | | | | | | | | | |
| HV-PAO1 | *12 | — | — | — | 1370 | 129 | 199 | — | — |
| HV-PAO2 | *13 | — | — | — | 3274 | 318 | 253 | — | — |
| HV-PAO3 | *14 | — | — | — | 1705 | 156 | 206 | — | — |
| Viscosity index improver | | | | | | | | | |
| PMA1 | *15 | — | — | — | — | — | — | — | — |
| PMA2 | *16 | — | — | — | — | — | — | — | — |

TABLE 1-continued

| Symbol for raw materials | Contents | Number of C | Number of O | O/C atomic ratio | Kinematic viscosity at 40° C. | Kinematic viscosity at 100° C. | Viscosity index | Right-side value of formula (1) | Formula (1) can be satisfied or unsatisfied |
|---|---|---|---|---|---|---|---|---|---|
| PMA3 | *17 | — | — | — | — | — | — | — | — |
| PMA4 | *18 | — | — | — | — | — | — | — | — |
| Lubricating oil additives | | | | | | | | | |
| CVT additive | *19 | — | — | — | — | — | — | — | — |

Note

*1: Diethylene glycol dibutyl ether;

*2: Diethylene glycol hexyl butyl ether;

*3: Triethylene glycol dibutyl ether;

*4: Oleic acid butoxyethyl ester;

*5: Triethylene glycol n-octanoic acid diester;

*6: Triethylene glycol monobutyl ether n-octanoic acid ester;

*7: Diethylene glycol n-decanoic diester;

*8: Dibutyl sebacate;

*9: Diethyl azelate;

*10: Di-2-ethylhexyl sebacate;

*11: 1-Decene oligomer ("Durasyn 162" available from INEOS);

*12: "IDEMITSU LINEARLENE PAO-V-120" available from Idemitsu Kosan Co., Ltd.;

*13: "SpectaSyn Ultra 300" available from Exxon Mobil Chemical Corp.;

*14: "SpectaSyn Elite" available from Exxon Mobil Chemical Corp. (product produced using a metallocene catalyst);

*15: Polymethacrylate having a weight-average molecular weight of 31,000;

*16: Polymethacrylate having a weight-average molecular weight of 200,000;

*17: Polymethacrylate having a weight-average molecular weight of 1,800,000;

*18: Polymethacrylate having a weight-average molecular weight of 420,000;

*19: Package containing a detergent (such as Ca sulfonate), a dispersant (such as succinic acid imide), an extreme pressure additive and an anti-wear agent (such as a sulfide, a phosphoric acid compound and a phosphorus sulfide compound), a defoaming agent, a copper deactivator, etc.

TABLE 2

| | | | Examples | | | | | | | | | |
|---|---|---|---|---|---|---|---|---|---|---|---|---|
| | | | 1 | 2 | 3 | 4 | 5 | 6 | 7 | 8 | 9 | 10 |
| Formulations of respective materials (% by mass) | Low-viscosity synthetic oil | ET1 | 57 | 56 | 42 | 30 | 65 | 61 | 57 | 54 | — | — |
| | | ET2 | — | — | — | — | — | — | — | — | 57 | — |
| | | ET3 | — | — | — | — | — | — | — | — | — | 55 |
| | | ETS1 | — | — | 19 | 36 | — | — | — | — | — | — |
| | | ETS2 | — | — | — | — | — | — | — | — | — | — |
| | | ETS3 | — | — | — | — | — | — | — | — | — | — |
| | | ETS4 | — | — | — | — | — | — | — | — | — | — |
| | | ES1 | — | — | — | — | — | — | — | — | — | — |
| | | ES2 | — | — | — | — | — | — | — | — | — | — |
| | | ES3 | — | — | — | — | — | — | — | — | — | — |
| | | PAO | — | — | — | — | — | — | — | — | — | — |
| | High-viscosity synthetic oil | HV-PAO1 | 27 | 32 | 27 | 22 | — | — | — | 31 | 28 | 30 |
| | | HV-PAO2 | — | — | — | — | 23 | 26 | — | — | — | — |
| | | HV-PAO3 | — | — | — | — | — | — | 24 | — | — | — |
| | Viscosity index improver | PMA1 | 7 | 4 | 4 | 4 | 4 | 4 | 4 | 4 | 4 | 4 |
| | | PMA2 | — | — | — | — | — | — | — | — | — | — |
| | | PMA3 | — | — | — | — | — | — | — | — | — | — |
| | | PMA4 | — | — | — | — | — | — | — | — | — | — |
| | Lubricating oil additives | CVT additive | 9 | 9 | 9 | 9 | 9 | 9 | 9 | 9 | 9 | 9 |
| Performance and properties of composition | Solubility | | OK | OK | OK | OK | OK | OK | OK | OK | OK | OK |
| | Kinematic viscosity at 40° C. | [$mm^2/s$] | 15.6 | 15.9 | 16.1 | 16.0 | 9.6 | 14.5 | 11.9 | 11.9 | 16.0 | 16.7 |
| | Kinematic viscosity at 100° C. | [$mm^2/s$] | 5.1 | 5.2 | 5.1 | 5.0 | 3.7 | 5.2 | 4.0 | 4.1 | 5.1 | 5.2 |
| | Viscosity index | [—] | 309 | 305 | 293 | 283 | 343 | 346 | 286 | 298 | 294 | 276 |
| | Shearing stability | (%) | 0.9 | 0.5 | 0.6 | 0.6 | 3.2 | 3.9 | 0.9 | 0.6 | 0.6 | 0.6 |
| | Flash point | (° C.) | 126 | 132 | 140 | 146 | 123 | 121 | 126 | 128 | 150 | 162 |

TABLE 3

| | | | Comparative Examples | | | | | | | | | |
|---|---|---|---|---|---|---|---|---|---|---|---|---|
| | | | 1 | 2 | 3 | 4 | 5 | 6 | 7 | 8 | 9 | 10 |
| Formulations of respective materials (% by mass) | Low-viscosity synthetic oil | ET1 | — | — | — | 32 | 45 | 30 | 30 | — | — | — |
| | | ET2 | — | — | — | — | — | — | — | — | — | — |
| | | ET3 | — | — | — | — | — | — | — | — | — | — |
| | | ETS1 | — | — | — | 39 | 20 | 36 | 36 | — | — | — |
| | | ETS2 | 57 | — | — | — | — | — | — | — | — | — |
| | | ETS3 | — | 57 | — | — | — | — | — | — | — | — |
| | | ETS4 | — | — | 57 | — | — | — | — | — | — | — |
| | | ES1 | — | — | — | — | — | — | — | 67.0 | — | — |
| | | ES2 | — | — | — | — | — | — | — | — | 58.0 | — |
| | | ES3 | — | — | — | — | — | — | — | — | — | 75.0 |
| | | PAO | — | — | — | — | — | — | — | — | — | — |
| | High-viscosity synthetic oil | HV-PAO1 | 27 | 27 | 27 | 21 | 21 | 20 | 20 | 25.0 | 34.0 | 17.0 |
| | | HV-PAO2 | — | — | — | — | — | — | — | — | — | — |
| | | HV-PAO3 | — | — | — | — | — | — | — | — | — | — |
| | Viscosity index improver | PMA1 | 7 | 7 | 7 | — | — | — | — | — | — | — |
| | | PMA2 | — | — | — | — | 5 | — | — | — | — | — |
| | | PMA3 | — | — | — | — | — | 5 | — | — | — | — |
| | | PMA4 | — | — | — | — | — | — | 5 | — | — | — |
| | Lubricating oil additives | CVT additive | 9 | 9 | 9 | 9 | 9 | 9 | 9 | 8.0 | 8.0 | 8.0 |
| Performance and properties of composition | Solubility | | NG | NG | NG | OK | OK | OK | OK | NG | NG | OK |
| | Kinematic viscosity at 40° C. | [$mm^2/s$] | — | — | — | 12.3 | 14.3 | 16.7 | 21.3 | — | — | 25.3 |
| | Kinematic viscosity at 100° C. | [$mm^2/s$] | — | — | — | 4.0 | 4.9 | 5.4 | 6.9 | — | — | 6.1 |
| | Viscosity index | [—] | — | — | — | 261 | 308 | 311 | 328 | — | — | 204 |
| | Shearing stability | (%) | — | — | — | — | 8.8 | 11.9 | 30.0 | — | — | 0.5 |
| | Flash point | (° C.) | — | — | — | 138 | 146 | 147 | 152 | — | — | 205 |

From Tables 2 and 3, the followings were recognized.

The respective lubricating oil compositions containing the specific low-viscosity synthetic oil, the specific high-viscosity synthetic oil and the specific viscosity index improver according to the present invention had a kinematic viscosity as low as 17 $mm^2/s$ or less as measured at 40° C. and an extremely high viscosity index, and further had a shearing stability as low as 3.9% or less. Also, these compositions exhibited a good solubility and therefore were in the form of a stable composition (Examples 1 to 10).

In addition, from the comparison between the results of Examples 1 and 2 and the results of Examples 3 and 4, it was confirmed that the lubricating oil compositions obtained in Examples 3 and 4 in which the compound containing an ester bond was used as the low-viscosity synthetic oil exhibited an increased flash point.

On the other hand, in Comparative Examples 1 to 3 in which the compounds containing an ether bond which were however incapable of satisfying the formula (1) were used as the low-viscosity synthetic oils, and in Comparative Examples 8 to 10 in which the low-viscosity synthetic oils were not compounds containing an ether bond, the resulting compositions suffered from defects such as production of an unstable composition, a large kinematic viscosity at 40° C. and a small viscosity index, i.e., all failed to achieve the aimed object of the present invention.

Furthermore, the composition obtained in Comparative Example 4 which contained no polyacrylate was insufficient in viscosity index, and the compositions obtained in Comparative Examples 5 to 7 which respectively contained the polyacrylate having a weight-average molecular weight of more than 50,000 were deteriorated in shearing stability.

INDUSTRIAL APPLICABILITY

In accordance with the present invention, it is possible to provide a lubricating oil composition having a low viscosity and an extremely high viscosity index as well as an excellent shearing stability which is excellent in saving of energy and reduction in fuel consumption. Therefore, the lubricating oil composition according to the present invention can be effectively used as various lubricating oil compositions such as transmission fluids for vehicles, e.g., those for a manual transmission, an automatic transmission, a continuous variable transmission (CVT) or the like, industrial bearing oils, industrial gear oils, gear oils for vehicles, etc.

The invention claimed is:

1. A lubricating oil composition, comprising:

(A) a low-viscosity synthetic oil comprising a non-ester-containing compound comprising an ether bond in a molecule thereof and having a kinematic viscosity of less than 10 $mm^2/s$ as measured at 40° C., in which a ratio of number of oxygen atoms to number of carbon atoms as constituents of the compound (O/C ratio) and the kinematic viscosity ($mm^2/s$) of the compound as measured at 40° C. satisfy the following formula (1):

$$\text{Kinematic Viscosity at } 40^\circ\text{ C.} \leq 12-[(\text{O/C ratio})\times 30] \quad (1);$$

(B) a high-viscosity synthetic oil as a hydrocarbon-based synthetic oil having a kinematic viscosity of 40 $mm^2/s$ or more as measured at 100° C. which comprises at least one compound selected from the group consisting of an α-olefin oligomer, a hydrogenated product of an α-olefin oligomer and an ethylene-propylene co-oligomer; and (C) a polymethacrylate having a weight-average molecular weight of 50,000 or less.

2. The lubricating oil composition according to claim 1, wherein the non-ester-containing compound is (a-1) a dialkyl ether of di- (or tri-) ethylene glycol (wherein two alkyl groups in the dialkyl ether may be the same or different from each other), and the low-viscosity synthetic oil (A) further comprises at least one compound selected from the group consisting of:

(a-2) a di- (or tri-) ethylene glycol containing an alkyl ether at one terminal end thereof and an alkyl ester at the other terminal end thereof; and (a-3) an alkoxyalkyl ester of a saturated or unsaturated fatty acid.

3. The lubricating oil composition according to claim 1, wherein the component (B) is at least one of an α-olefin oligomer and a hydrogenated product of an α-olefin oligomer which have a kinematic viscosity of from 100 to 1,000 $mm^2/s$ as measured at 100° C.

4. The lubricating oil composition according to claim 1, wherein the component (B) is an α-olefin oligomer that is produced with a metallocene catalyst, a hydrogenated product of the α-olefin oligomer, or both.

5. The lubricating oil composition according to claim 1, wherein a content of the component (C) in the lubricating oil composition is 15% by mass or less on the basis of a total amount of the component A, the component B and the component C.

6. The lubricating oil composition according to claim 1, wherein a content of the component (A) in the lubricating oil composition is from 5 to 80% by mass, and a content of the component (B) in the lubricating oil composition is from 10 to 80% by mass, both on the basis of a total amount of the component A, the component B and the component C.

7. The lubricating oil composition according to claim 1, wherein the lubricating oil composition has a kinematic viscosity of 3 $mm^2/s$ or more as measured at 100° C.

8. The lubricating oil composition according to claim 1, wherein the lubricating oil composition has a viscosity index of 250 or more.

9. The lubricating oil composition according to claim 1, further comprising, as a component (D), at least one lubricating oil additive selected from the group consisting of an antioxidant, an extreme pressure agent, an anti-wear agent, a dispersant and a metal-based detergent.

10. A transmission fluid for vehicles, comprising the lubricating oil composition of as claimed in claim 1.

11. The lubricating oil composition according to claim 1, wherein the non-ester-containing compound is (a-1) a dialkyl ether of di- (or tri-) ethylene glycol (wherein two alkyl groups in the dialkyl ether may be the same or different from each other), and the low-viscosity synthetic oil (A) further comprises (a-2) a di- (or tri-) ethylene glycol containing an alkyl ether at one terminal end thereof and an alkyl ester at the other terminal end thereof.

12. The lubricating oil composition according to claim 1, wherein the non-ester-containing compound is (a-1) a dialkyl ether of di- (or tri-) ethylene glycol (wherein two alkyl groups in the dialkyl ether may be the same or different from each other), and the low-viscosity synthetic oil (A) further comprises (a-3) an alkoxyalkyl ester of a saturated or unsaturated fatty acid.

13. The lubricating oil composition according to claim 1, wherein the non-ester-containing compound is (a-1) a dialkyl ether of di- (or tri-) ethylene glycol (wherein two alkyl groups in the dialkyl ether may be the same or different from each other), and the low-viscosity synthetic oil (A) further comprises:

(a-2) a di- (or tri-) ethylene glycol containing an alkyl ether at one terminal end thereof and an alkyl ester at the other terminal end thereof; and (a-3) an alkoxyalkyl ester of a saturated or unsaturated fatty acid.

14. The lubricating oil composition according to claim 1, wherein the non-ester-containing compound is selected from the group consisting of diethylene glycol dibutyl ether, diethylene glycol hexyl butyl ether and triethylene glycol dibutyl ether.

15. The lubricating oil composition according to claim 1, wherein the low-viscosity synthetic oil (A) comprises at least one selected from the group consisting of a decanoic acid alkyl ester, an octanoic acid alkyl ester and a nonanoic acid alkyl ester.

16. The lubricating oil composition according to claim 1, wherein the low-viscosity synthetic oil (A) comprises at least one selected from the group consisting of palmitoleic acid butoxyethyl ester, oleic acid butoxyethyl ester and elaidic acid butoxyethyl ester.

17. The lubricating oil composition according to claim 1, wherein the high-viscosity synthetic oil (B) comprises an α-olefin oligomer, a hydrogenated product of an α-olefin oligomer, or both, formed from at least one α-olefin selected from the group consisting of 1-octene, 1-nonene, 1-decene, 1-undecene and 1-dodecene.

* * * * *